United States Patent [19]

Patterson

[11] 4,189,879

[45] Feb. 26, 1980

[54] EARTH ANCHOR

[76] Inventor: Merle W. Patterson, 2635 E. 28th St., Tulsa, Okla. 74114

[21] Appl. No.: 857,781

[22] Filed: Dec. 5, 1977

[51] Int. Cl.[2] ..... E02D 5/74

[52] U.S. Cl. ..... 52/161

[58] Field of Search ..... 52/160, 161, 162, 164; 114/307, 304, 305, 311

[56] References Cited

U.S. PATENT DOCUMENTS

| | | | |
|---|---|---|---|
| 7,207 | 3/1850 | Bell | 114/311 |
| 129,878 | 7/1872 | Wilson | 114/311 |
| 289,224 | 11/1883 | Clarke | 114/311 |
| 1,606,147 | 11/1926 | Cole | 52/161 |
| 2,032,089 | 2/1936 | Handel | 52/160 |
| 2,217,271 | 10/1940 | Handel | 52/161 |
| 2,491,564 | 12/1949 | Iversen | 114/311 |
| 2,570,646 | 10/1951 | Cole | 52/160 |
| 3,056,477 | 10/1962 | Wooley | 52/160 |
| 3,325,955 | 6/1967 | Hart | 52/514 |

*Primary Examiner*—James A. Leppink
*Assistant Examiner*—Henry E. Raduazo
*Attorney, Agent, or Firm*—James H. Chafin

[57] ABSTRACT

An earth anchor having a plurality of anchor arms which are extendable after being placed in position. A flexible skirt member is attached to the anchor arms whereby after insertion into the hole, the anchor arms and skirt member may be extended into undisturbed earth thereby providing an anchoring surface at least as great as the surface area of the skirt member.

7 Claims, 9 Drawing Figures

EARTH ANCHOR

BACKGROUND OF THE INVENTION

1. Field of the Invention

The present invention relates to earth anchors and more particularly, but not by way of limitation, to an earth anchor having retractable anchor arms and an anchor skirt which is particularly suited to anchoring in soft earth, swamp or marsh lands.

2. History of the Prior Art

There have been many innovations in the development of earth anchors for supporting guy wires, anchoring mobile homes and the like. Many of these developments include anchors which have rectractable arms and after insertion into the anchoring hole, these arms are extended into the surrounding earth to provide the anchoring function.

However, the present art anchoring devices have not been totally successful for use in soft earth such as sand and around streams, rivers, lakes and oceans or in marsh lands.

In the construction of pipelines across swamps and the like, the pipelines have been anchored by the sinking of large concrete weights having attachment cables for connecting the pipeline thereto. This method has the obvious disadvantages of requiring large swamp barges for handling the concrete blocks, the gradual sinking of these blocks due to their weight and the costs of the blocks and the handling thereof.

One of the primary reasons for the failure of earth anchors in such applications is that in order to make the anchor arms retract into a package small enough to be inserted into a small drilled hole, the anchor arms must be rather narrow. Once these narrow anchor arms are extended into the soft earth, they simply do not have sufficient cross-sectional area to provide the necessary holding power. Admittedly, the arms may be made wider as taught in the patent to G. E. Beck, U.S. Pat. No. 1,081,654 issued Dec. 16, 1913, but it is then obvious that the arms cannot be retracted to fit a hole of a diameter less than the width of each one of these arms.

Further, in the use of retractable anchor arms, there has been a constant danger of the locking mechanism which holds the anchor arms into an extended position becoming loose and thereby allowing the arms to inadvertently retract and loose their anchoring power.

SUMMARY OF THE INVENTION

The present invention provides an earth anchor having a retractable anchoring mechanism and which can be positively locked in its extended position. Further, the anchoring mechanism which may be retracted for insertion into a relatively small hole, may also be extended into the surrounding earth to provide a large holding surface area. The anchor arm mechanism is designed such that the extension thereof provides a minimum of disturbance to the surrounding virgin earth which again provides for greater holding power.

The anchor generally comprises an elongated center rod, the upper end of which is provided with any desirable anchoring hook or connector means. The lower end of the rod is provided with a conical shaped base member having a diameter substantially equal to the minimum diameter of the anchor when the arms are retracted. Stated another way, the diameter of the conical base member dictates the minimum size hole must be drilled for inserting the anchor.

The center rod is surrounded by a sleeve member which is slidable with respect to the rod and the lower end of the sleeve member is provided with a circular plate having a diameter smaller than the conical case member. The anchoring arms, in their retracted position are carried between the circular plate and the conical base member, each arm being pivotally attached to one or the other depending on the particular embodiment. The extension of the anchor arms is effected by moving the sleeve member downwardly with respect to the rod thereby forcing the arms outwardly into the surrounding soil or earth.

A flexible skirt member is carried by the upper surface of the extendable anchor arms and is pleated or otherwise folded into the space between the circular plate and the conical base member when the arms are retracted.

The outer edge of the skirt is connected to the outer ends of the anchor arms so that when the arms are extended into the undisturbed earth, surrounding the anchor hole, the outer edge of the skirt is carried along with the anchor arms. The skirt is sized such that when the arms are fully extended the outer edge of the skirt is stretched tightly between the ends of the anchor arms which will form a polygon shaped surface area. The inner edge of the skirt is attached to either the circular plate or the conical base member and since it lies on top of the anchor arms, it is supported by the arms. The result is a large load carrying surface area which will greatly resist forces pulling on the anchor rod.

Further, since the extension and retraction is accomplished by relative movement of the rod in the sleeve member, the device is locked into an extended position by a nut threaded on the upper end portion of the center rod and being snugged down against the upper end of the sleeve member after the device has been extended.

Another safety against inadvertent retraction of the arms is accomplished by one embodiment of the device having anchor arms that extend upwardly and outwardly into the surrounding soil so that an upward force on the anchor tends to hold the anchor open rather than to close it.

DESCRIPTION OF THE DRAWINGS

Other and further advantageous features of the present invention will hereinafter more fully appear in connection with a detailed description of the drawings in which.

DETAILED DESCRIPTION OF THE PREFERRED EMBODIMENT

Figure 6:
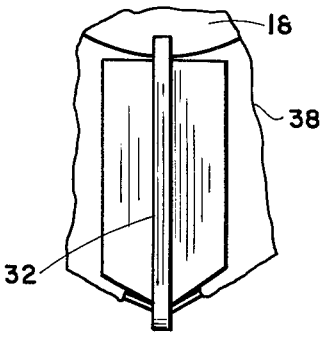
FIG. 6 is a detailed view of a second configuration of an anchor arm member.

Referring to the drawings in detail, and particularly to FIGS. 1 through 6, reference character 10 generally indicates an earth anchor inserted into a drilled hole indicated by reference character 12. The anchor 10 generally comprises an elongated center rod 14, the upper end portion of which is threaded at 16, the lower end thereof being provided with a conical shaped base member 18, the apex of the base member extending outwardly from the end rod 14. The rod 16 is slidably disposed within an elongated sleeve member 20, the outer end 22 thereof extending essentially adjacent to the outer end threaded portion 16 of the rod 14. The inner end of the sleeve member 20 is provided with a circular plate member 24 which is rigidly secured thereto.

The upper or inner surface of the conical base member 18 is provided with a plurality of outwardly extending pairs of ear members 26 which the radially spaced from the center of the inner surface of the conical base member 18. An elongated anchor arm member 28 is pivotally attached to one end of each pair of ear members 26 by means of pivot pins 30.

Each anchor arm member 28 comprises an elongated rib member 32 one end of which is pivotally attached to the ear members 26 as hereinbefore set forth. The outer edge of each rib member 32 is arcuate in shape to form a convex curve. Along the outer edge of the rib member 32 is an elongated plate member 34 which can be constructed of a thinner material and may even be made at an integral part with the rib member 32 and follows the convex arcuate curvature of the rib member 32. The plate may be substantially flat or, to provide added strength capabilities as will be hereinafter set forth, may be constructed with oppositely disposed leaf members having the cross-sectional angle with respect to the rib member of less than 90° as is clearly shown in FIG. 4. The lower end of the rib member 32 adjacent the pivotal attachment point is provided with an outwardly extending stop member 36 for a purpose that will be hereinafter set forth.

Figure 3:
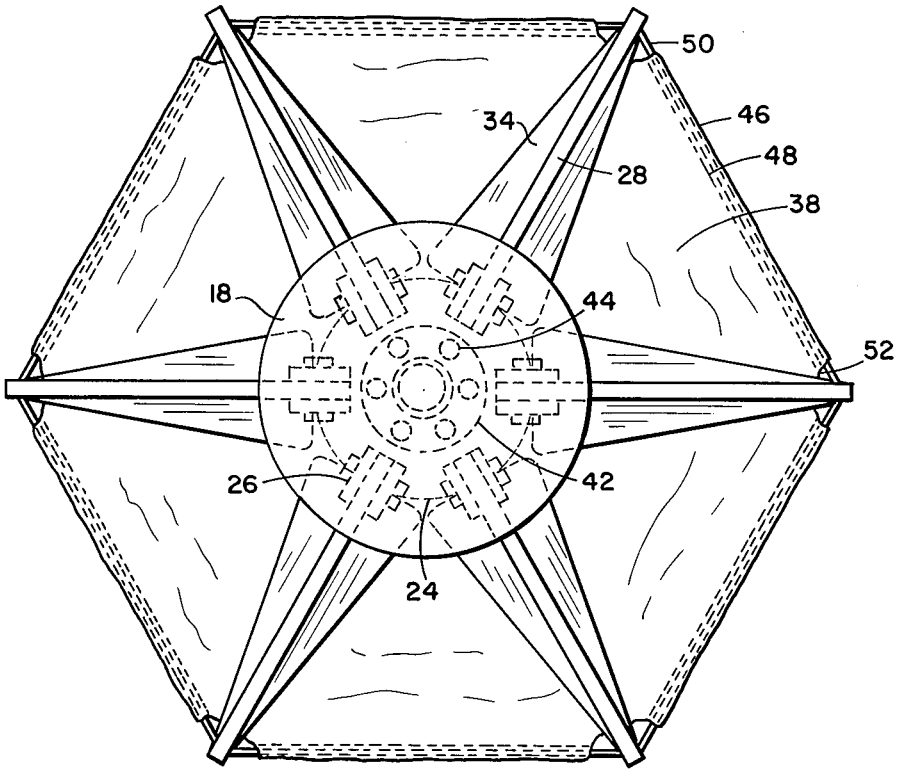
FIG. 3 is a bottom view of the anchor as shown in FIG. 2.

Referring now to FIG. 3, a flexible polygon shaped skirt member 38 having a central circular aperture 40 therein, which constitutes the inner edge thereof is secured to the upper or outer surface of the conical base member 18, the circular aperture 40 surrounding the lower or inner end of the rod 14. The skirt member is attached by means of the plate member 42 which may be tightened against the conical member 18 by a plurality of screws 44, the inner edge of the skirt member 38 being sandwiched therebetween.

The outer edge 46 of the skirt member 38 has a polygon shape with the number of sides being equal to the number of anchor arm members 28. The outer edge 46 of the skirt member 38 is provided with a seam or aperture 48 for accepting an elongated cable 50 therearound. There is a cut out portion 52 at each vertex of the polygon shaped skirt member thereby exposing the cable 50 at each said cutout.

Figure 1:
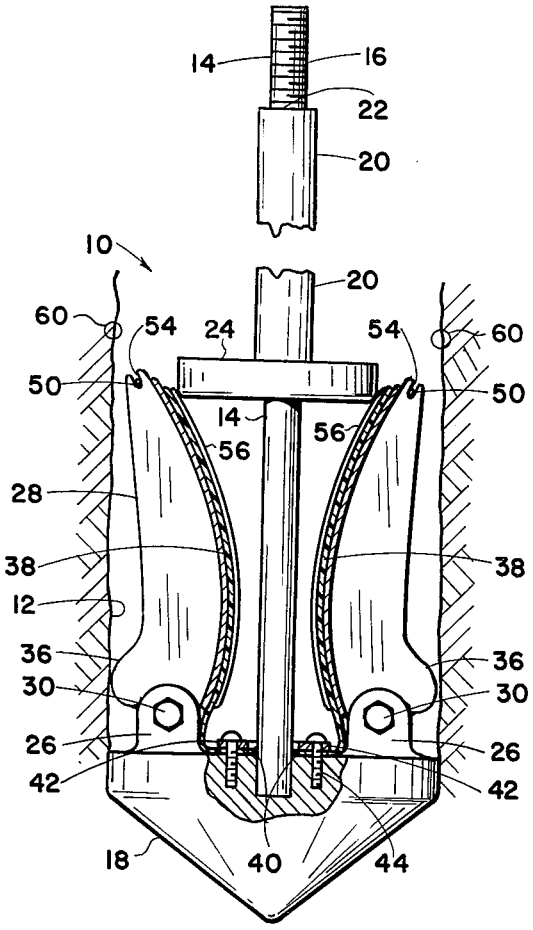
FIG. 1 is a partial sectional elevational view of a first embodiment of the invention having the anchor arms retracted.
Figure 2:
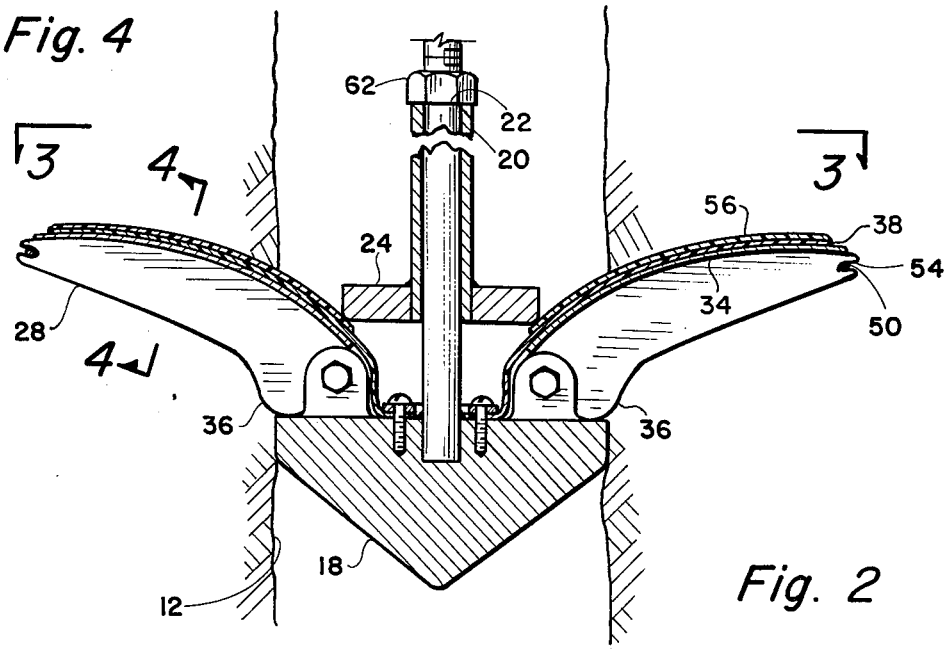
FIG. 2 is a sectional elevational view of the anchor of FIG. 1 showing the arms extended.

Referring now to FIGS. 1 and 2, each anchor arm member 28 is provided with a transverse slot 54 at the outer end thereof, the slots 54 being of a size capable of snuggly receiving the exposed portions of the skirt member cable 50 therein.

The skirt member 38 further, is provided with a plurality of radially extending rib members 56 which, upon being installed on the outer surface of the plate members 34, said skirt rib is positioned directly over each rib member 32 of the anchor arms 28. The inside surface of the skirt member 38 may be glued or bonded directly to the outer surface of the plate members 34 of each anchor arm in order to hold the rib member 56 in the desired position directly over the anchor arm rib member 32.

The anchor is installed by first drilling an anchor hole 12 in the earth and folding the anchor arms upwardly against the lower edge of the circular plate 24 of the sleeve member 20. The flexible skirt member 38 is folded or pleated back into the spaces provided between the anchor arms in the folded position. The circular plate member 24 is positioned so that the lower edge thereof rests directly on the outer end of the skirt member radially extending rib 56.

The entire anchor is then lowered into the drilled hole 12 as shown in FIG. 1 and is ready for extension of the anchor arms. In order to extend the anchor arms, the upper end of the sleeve member 20 is substantially held in place while a pulling force is exerted on the rod member 14. This in turn pulls the conical shaped base member 18 and attached anchor arms upwardly thereby causing the ridge member 56 of the skirt member to slide against the lower edge of the circular plate 24. As the rod continues its upward motion the outer end of the anchor arm members 28 will intersect the sides of the hole 12 at approximately the positions shown by reference characters 60. When the anchor members 28 contact the earth surrounding the hole, at the point 60, they begin digging into the earth pulling the outer edge 46 of the skirt member 38 outwardly also into the earth.

Since the outer surface of the anchor arms 28 is provided with a convex curvature, the anchor arm and associated plate members 34 along with the skirt member 38 will tend to cut into the ground and follow the initial cut thereby causing a minimum disturbance to the earth surrounding the hole 12.

When the anchor arms are fully extended as shown in FIG. 2, further travel will be stopped by the stop members 36 coming in contact with the upper surface of the conical base member 18. At this point, the lower edge of the circular plate member 24 will be positioned on the inner ends of the rib members 56 of the skirt and will further tend to hold the anchor arms 28 in an extended position.

To further securely lock the anchor in an extended position, a nut 62 is threaded on the upper end of rod 14 and is moved downwardly and snugged against the upper surface 22 of a sleeve member 20. Therefore, the anchor arms cannot become inadvertently retracted so long as said nut 62 is in position as shown in FIG. 2. It can further be seen that in FIG. 3, when the anchor arms 28 are in their extended position, the skirt member 38 is expanded to its polygon shape thereby providing an enlarged surface area in contact with the earth to resist a pulling force on the anchor itself. Since the skirt member is disposed on the outer or upper surface of the anchor arms 28, the pulling forces which are the only forces that should be encountered by anchor usage, will force the skirt member down against the plates 34 which will therefore support the skirt member and help prevent tearing or damage thereof. The angled configuration of the anchor arm plates of FIG. 4 will further match the curvature of the skirt member and may serve to prevent damage to the skirt under a loaded condition.

Figure 9:
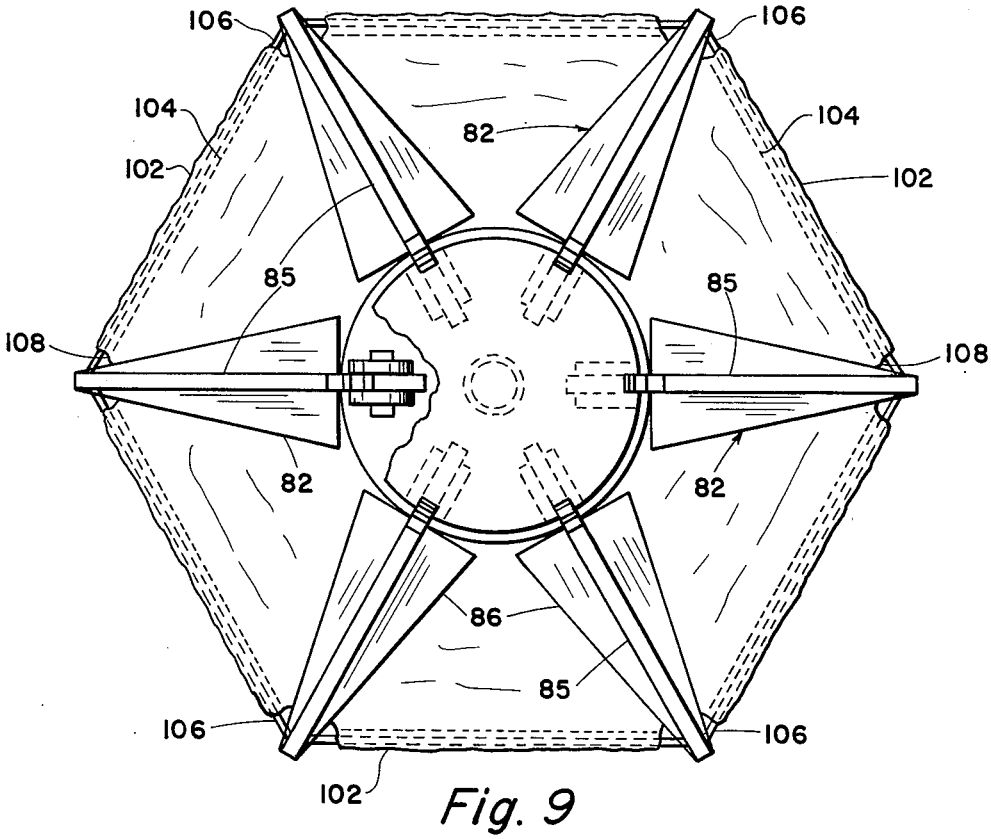
FIG. 9 is a bottom view of the anchor as shown in FIG. 8.
Figure 7:
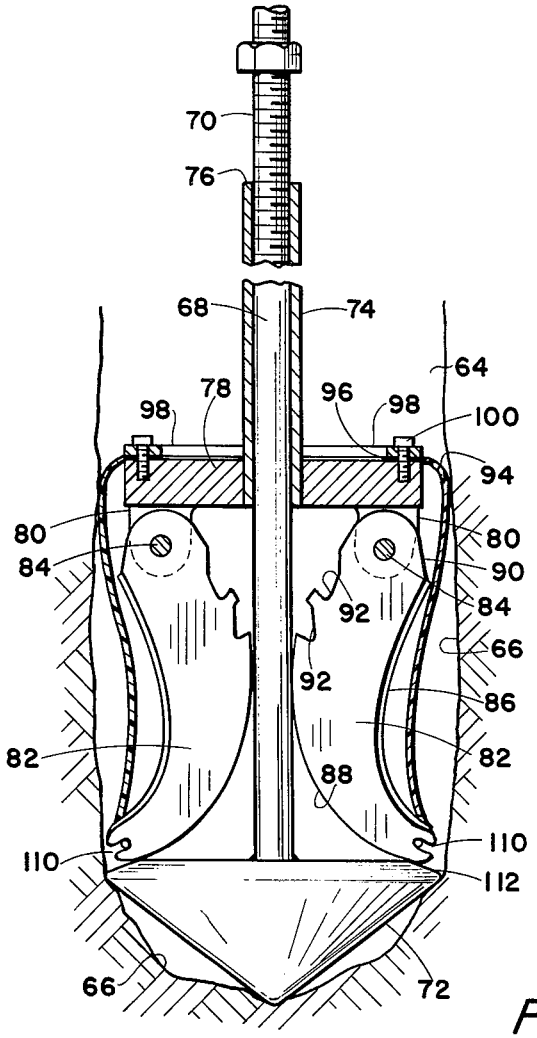
FIG. 7 is a partial sectional elevational view of the second embodiment of the invention with the arms shown in a retracted position.
Figure 8:
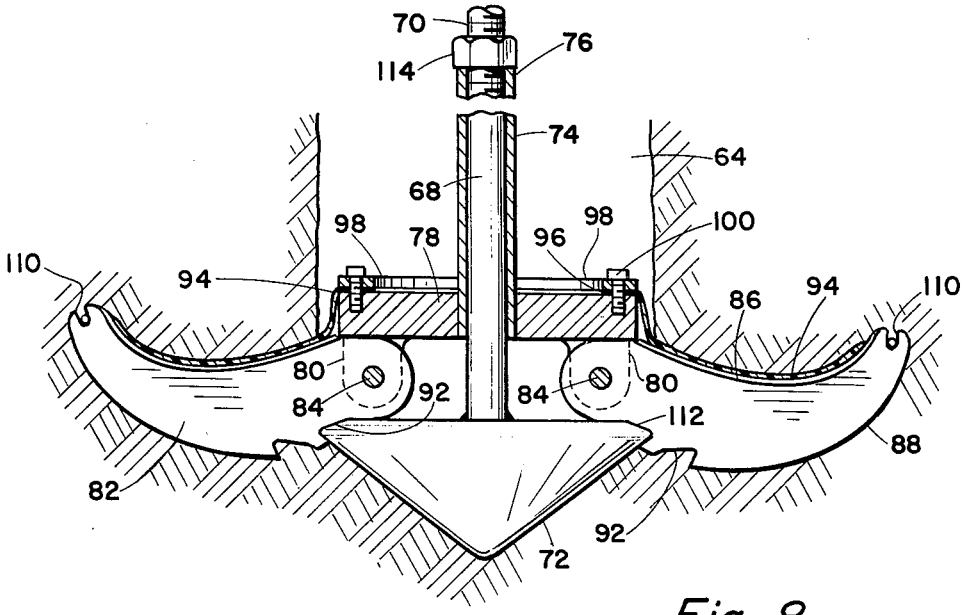
FIG. 8 is an elevational sectional view of the anchor of FIG. 7 with the arms in an extended position.

Referring now to FIGS. 7 through 9, reference character 64 generally depicts a second embodiment of an earth anchor disposed in the bottom of a hole 66 in the earth.

The earth anchor 64 generally comprises a centrally disposed elongated rod member 68 which is threaded at 70 near one end thereof, the opposite end thereof being provided with a conical base member 72 having the apex thereof facing downwardly or outwardly from the rod 68. The conical base member 72 is ridgidly secured to the end of the rod 68 by any well known manner such as by welding.

The anchor also comprises an elongated sleeve member 74 which surrounds the rod 68, the rod 68 being slidably disposed therein. One end of the sleeve member 74 terminates with annular end portion 76 and is disposed opposite the threads 70 on the rod member 68. The opposite end of the sleeve member 74 is provided with a circular plate 78 secured thereto much in the same manner as the arrangement described in relation to the earth anchor 10.

However, in the case of the earth anchor 64, the lower surface of the circular plate 78 is provided with a plurality of pairs of ear members 80 which are radially spaced from the center thereof. A plurality of elongated anchor arm members 82 are pivotally secured, one to each pair of ears 80 by means of pivot pins 84. The anchor arms members 82 generally comprise an elongated central rib member 85 having a flat plate member 86 secured along the outer edge thereof. The outer edge of each rib member 85 and plate member 86 has an arcuate shape, concaved outwardly for a purpose that will be hereinafter set forth. The opposite edge of each arm 82 is also arcuate in shape forming a convex surface 88. The outer edge of the rib member 84 adjacent the pivot pin is tapered inwardly to form a shoulder member 90 for a purpose that will be hereinafter set forth. The inner edge of each rib member is provided with a plurality of notches 92 spaced therealong, also for a purpose that will be hereinafter set forth.

The anchor 64 also comprises a polygon shaped flexible skirt member 94 having a central aperture 96 therein. The rod and sleeve members are threaded through the aperture 96 so that the entire circular inner edge of the skirt member 94 is secured to the upper surface of the circular plate 78 by means of an apertured plate member 98. The plate member 98 is secured to the circular plate member 78 by a plurality of screws 100 such that the inner edge of the skirt member 94 is sandwiched therebetween.

The outer edge of the skirt member, designated as reference character 102, is polygon shaped and has the same number of sides as the number of anchor arm members 82. The outer edge 102 is provided with a seam 104 creating an aperture on the edge thereof for receiving an elongated cable 106 therethrough. The vertices of the polygon shaped edge 102 are cut away at 108 exposing a portion of the cable 106 at each of the vertices.

The outer ends of each anchor arm member 82 is provided with a notch or transverse notch or groove 110 for receiving the exposed cable segments therein.

The earth anchor 64 is utilized by first drilling a suitable sized hole 66 for insertion of the anchor 64 therein. The anchor 64 is folded into its most compact shape as shown in FIG. 7 by retracting the anchor arm members 82 into the space between the conical shaped base member 72 and the circular plate member 78. The skirt member 94 is folded and pleated into the spacing between the anchor arm members so that the entire lower portion of the anchor arm is configured as shown in FIG. 7. The anchor member is then lowered into the ground with the conical base member 72 being in contact with the bottom of the hole 66.

The anchor arm members 82 are then extended by moving the sleeve member 74 downwardly with respect to the rod member 68 thereby forcing the anchor arm members 82 downwardly and outwardly. To aid in this movement, the upper outer edge of the conical shaped base member is provided with a bevel at 112 so that the inner arcuate convex surface 88 may slide therealong as the arms are being extended. The curvature of the arms 82 are such that they will move into the surrounding earth with a minimum amount of disturbance. The sleeve member 74 and circular plate 78 are lowered until one or more of the shaped notches 92 receive the outer bevelled edge 112 of the conical shaped base member 72. It can be seen that notches 92 then will prevent inadvertent retraction of the anchor arm members 82.

While the anchor arm members 92 are moving into the earth, they will pull with them the outer edge 102 of the polygon shaped skirt member 94, the said outer edge of the skirt member 102 being supported by the cable member 106 so that they also are cutting through the earth. When the anchor arm members 82 reach their outermost position, the shoulder member 90 thereof will contact the lower surface of the circular plate member 78 to prevent any further extension. When the anchor arm member reaches the outermost position, the cable 106 within the skirt member 94 is extended to its full polygon shape as shown in FIG. 9 with the skirt member 94 resting on the outer surface of the anchor arm plate members 86.

As a backup locking means, in addition to the notches 92 on the lower surface of the anchor arm members, the anchor is provided with a nut member 114 which is threaded onto the threads 70 of the center rod 68. The nut member is tightened down against the outer end 76 of the sleeve member 74 to prevent inadvertent retraction of the arm members should the notches break out or fail to seat.

It can be seen that the resistance to pulling the expanded anchor out is proportional to the surface contact of the skirt member with the soil so that in the case of a soft earth, sand, or marsh land, the skirt member provides added anchoring resistance.

Figure 5:
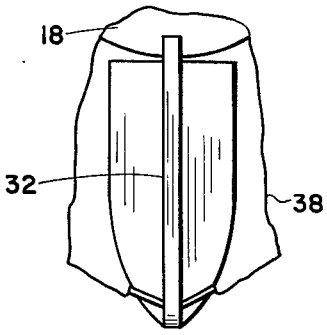
FIG. 5 is a detailed view of an anchor arm member and associated skirt portion.
Figure 4:
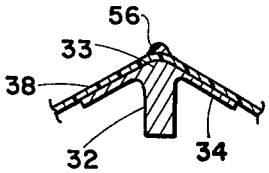
FIG. 4 is a sectional view of an anchor arm and associated skirt member taken along the broken lines 4—4 of FIG. 2.

It is further noted that although the plate members 86 of the anchor arm members 82 are shown as wedge-shaped in FIG. 9, they may be provided with substantially any suitable shape such as the spade shape of FIG. 5 or the tapered end shape of FIG. 6.

It is to be understood that the flexible skirt members while being shown and described herein as a material such as plastic having the outer edge supported and reinforced by a cable or chord, can be constricted of a flexible sheet of metal in which case a cable along the outer edge would not be required.

Although the use of the skirt member is primarily designed and positioned to withstand large pulling or tension loads, it is also obvious that it will provide great resistance to compression loads.

From the foregoing, it is apparent that the present invention provides two embodiments of an earth anchor which is particularly adaptable for use in anchoring objects into soft earth. Naturally these anchors can be used in any type of soil configuration with or without the skirt members and is therefore not necessarily limited thereto.

Whereas, the present invention has been described in particular relation to the drawings attached hereto, other and further modifications apart from those shown or suggested herein may be made within the spirit and scope of the invention.

What is claimed:

1. An earth anchor for securing objects to the earth comprising:

(a) an elongated anchor rod having inner and outer ends;

(b) a plurality of extendable anchor arm members having inner and outer surfaces pivotally carried by the inner end of the anchor rod;

(c) a single flexible skirt member secured to the anchor arms such that when the anchor arms are extended into the earth, the skirt member is spread over the outer surface of the extended anchor arms to provide an enlarged retaining surface; and (d) cam follower means carried by the anchor rod and operably engageable with the anchor arm members through the skirt member for extending the anchor arms into the earth.

2. An earth anchor as set forth in claim 1 wherein the skirt member has an outer edge secured to the ends of the anchor arms such that extension of the anchor arms pull the skirt into the earth until it is spread over the anchor arms.

3. An earth anchor as set forth in claim 2 wherein the outer edge of the skirt is polygon in shape and is reinforced along said outer edge by a flexible cable, the cable being connected to the outer ends of the anchor arms.

4. An earth anchor for securing objects to the earth comprising:

(a) an elongated anchor rod having inner and outer ends, said anchor rod comprising an elongated rod member slidably carried by an elongated sleeve member having inner and outer ends;

(b) a plurality of extendable anchor arm members having inner and outer surfaces carried by the inner end of the rod;

(c) means for extending the anchor arms into the earth comprising a pair of oppositely disposed plates, the first plate being secured to the inner end of the rod member and a second plate being carried by the inner end of the sleeve member, the anchor arms being pivotally carried therebetween; and (d) a single flexible skirt member secured to the anchor arms such that when the anchor arms are extended into the earth, the skirt member is spread over the outer surface of the extended anchor arms to provide an enlarged retaining surface;

whereby relative movement of the first plate toward the second plate forces pivotal extention of the arms into the earth.

5. An earth anchor as set forth in claim 4 wherein the outer end portion of the rod member is threaded for receiving a threaded nut thereon whereby after extension of the arms have been effected, said threaded nut may be tightened against the outer end of the sleeve member for locking the arms in an extended position.

6. An earth anchor as set forth in claim 4 wherein the arms are pivotally carried by the first plate and are retractable into the space between the first second plates, said arms being curved outwardly such that when the first plate is moved toward the second plate, the arms are forced into the earth along its path defined by their curvature whereby there is a minimum disturbance of the earth.

7. An earth anchor as set forth in claim 4 wherein the arms are pivotally carried by the second plate and are returnable into the space between the earth and the second plates, said arms being curved outwardly such that when the second plate is moved toward the first plate, the arms are forced into the earth along a path defined by their curvature whereby there is a minimum disturbance of the earth.

* * * * *